US007219808B2

(12) United States Patent
Wright et al.

(10) Patent No.: US 7,219,808 B2
(45) Date of Patent: May 22, 2007

(54) DISPLAY RACK FOR LEVELS

(75) Inventors: Randall J. Wright, Mukwonago, WI (US); Robert J. Kram, Muskego, WI (US)

(73) Assignee: Empire Level Mfg. Corp., Mukwonago, WI (US)

( * ) Notice: Subject to any disclaimer, the term of this patent is extended or adjusted under 35 U.S.C. 154(b) by 253 days.

(21) Appl. No.: 10/867,543

(22) Filed: Jun. 14, 2004

(65) Prior Publication Data

US 2005/0274682 A1 Dec. 15, 2005

(51) Int. Cl.
*A47F 7/00* (2006.01)
*A47F 5/08* (2006.01)

(52) U.S. Cl. ..... 211/70.6; 211/13.1; 211/DIG. 1; 211/59.1

(58) Field of Classification Search ..... 211/DIG. 1, 211/70.6, 59.1, 54.1, 57.1, 85.26, 87.01, 88.01, 211/13.1, 60.1; 248/683, 350, 206.5, 309.4; 206/818; 220/483
See application file for complete search history.

(56) References Cited

U.S. PATENT DOCUMENTS 3,058,504 A * 10/1962 Powers ..... 211/70.2
3,776,387 A * 12/1973 Brent ..... 211/70.6
3,782,799 A * 1/1974 Hansen ..... 313/206
4,405,108 A 9/1983 Muirhead
4,544,067 A 10/1985 Miller
4,621,738 A * 11/1986 DeLucchi ..... 211/70.6
4,677,780 A 7/1987 Shuman
4,703,575 A 11/1987 Diamond
4,826,059 A * 5/1989 Bosch et al. ..... 224/183
4,899,894 A * 2/1990 Crump ..... 211/70.2
4,905,847 A 3/1990 Hanson
5,031,777 A * 7/1991 Knox ..... 211/85.3
5,115,919 A 5/1992 Dorman
5,221,132 A 6/1993 Combs et al.
6,003,685 A * 12/1999 Malin ..... 211/7
6,216,888 B1 * 4/2001 Chien ..... 211/87.01
6,481,583 B1 11/2002 Black et al.
6,516,555 B2 * 2/2003 Buzzell ..... 43/57.1
7,051,884 B2 * 5/2006 Dick ..... 211/70.6

* cited by examiner

*Primary Examiner*—Jennifer E. Novosad
(74) *Attorney, Agent, or Firm*—Jansson Shupe & Munger Ltd.

(57) ABSTRACT

A rack for displaying a number of magnetic measuring/gauging devices held in a releasable manner. The rack has a rigid, vertically planar, magnetically-attractable holder, a rigid, horizontal tray secured to the lower edge of the holder and configured to engage one of the ends of each device, and an attachment member secured to the rear edge of the holder for mounting the rack to a display structure. Preferably, the measuring/gauging devices are torpedo levels. A label-plate can be attached to the front edge of the holder. The display rack in certain embodiments is capable of attachment to either a cross-bar or a pegboard. In other embodiments, the display rack has two holder-plates and a stand member for engaging a display surface.

29 Claims, 4 Drawing Sheets

DISPLAY RACK FOR LEVELS

FIELD OF THE INVENTION

This invention is related generally to apparatus for displaying retail goods and, more particularly, to an apparatus for displaying magnetic measuring/gauging devices.

BACKGROUND OF THE INVENTION

Hardware stores and home-centers constitute a growing segment of the retail market. More homeowners are deciding to tackle a wide variety of home improvement and repair projects themselves so that they save money and add value to their homes. Competition between these retailers has increased in recent years with the customers usually patronizing the store that they find makes it easiest for them to obtain the materials needed to complete their work.

One of the reasons that a homeowner commonly travels to a hardware store is the need to purchase a certain tool or other item. Searching for this particular product at such outlets can, however, be often difficult and frustrating. The number of sales personnel available to provide help is always limited and the customer can easily become disoriented in the huge expanse of the modern home-center with its aisle after aisle of tools and building materials.

Most customers have little interest or time, however, to scour a store in order to find the various items on their list. Oftentimes, the search can even become an exercise in futility since the tool sought may be difficult to identify from the multitude of other hardware displayed on the shelves or in the bins.

A way of catching the eye of the customer to spare him or her from the needless waste of time spent hunting down the desired tool is therefore an aim of nearly all retailers. Any apparatus that prominently and openly displays a specific product has particular value in this regard. These displays not only facilitate the ability of the customer to locate these products within the store but often promote impulsive purchases of such items by other customers as well.

Many displays of this nature are designed to be mounted to only one specific type of support surface. Most also include a means of holding or securing the various items being displayed that is built into the apparatus. Certain tools are capable, however, of securing themselves to a display without the need of any assistance of this type. Moreover, the retailer may be losing an excellent opportunity for highlighting a feature of such products that would otherwise be missed by the customer. In particular, suspending magnetic levels from hooks or similar devices in the same manner as non-magnetic ones does little to call to the customer's attention the usefulness of the magnetic devices and how they are distinctive from other levels.

A display rack therefore that overcomes these disadvantages and that uses an inherent property of the tools being displayed to firmly engage them to a simple and inexpensive apparatus would be highly desirable.

OBJECTS OF THE INVENTION

It is a primary object of this invention to provide a display rack that overcomes some of the problems and shortcomings of the prior art.

Another object of this invention is to provide a novel display rack that is capable of holding magnetic levels in a visible and easily accessible upright position.

Another object of this invention is to provide an exceptional apparatus that displays magnetic levels in a manner that facilitates selection and promotes sales.

Yet another object of this invention is to provide an excellent display rack for presenting certain magnetic tools in a fashion that catches the eye of the customer without interfering with the overall appearance of the retail establishment.

Still another object of this invention is to provide a desirable display rack that can be mounted to a pegboard or other conventional wall surface structures and extend outward to make access to the tools displayed easier and more convenient to the customer.

Another object of the invention is to provide an exceptional apparatus that can be simple and inexpensive to construct, easy to maintain, and highly reliable to use.

SUMMARY OF THE INVENTION

This invention is for a display rack that can be used to display a number of magnetic measuring/gauging devices from a display structure by removably securing them to the rack. The display rack in one aspect of the present invention has a rigid holder made from a material that is magnetically-attractable, i.e. attracted to a magnet but not necessarily exhibiting any of the properties of a magnet itself. Highly preferred is a material that has none of the properties of a magnet. One such preferred material is ferrous metal.

The holder has two vertical surfaces that are each configured to allow the magnetic element in a lateral-edge of each device displayed to magnetically engage the rack. The rack further includes a rigid horizontal tray attached to the bottom of the holder and an attachment member on the rear of the holder that mounts the rack to the associated display structure. The rack's tray is sized to engage and support one end of each measuring/gauging device being displayed and preferably the tray extends orthogonally outward from both sides of the holder.

In some desired embodiments, the holder is contiguous from its upper edge to its lower edge, having no breaks in the rack's magnetically-attractable vertical surfaces. In other preferred embodiments, the rack includes a label-plate that can be used to set out indicia directed to the devices being displayed.

Certain desired cases find the measuring/gauging device to be an elongate frame-type level. These levels have a generally rectangular body with squared-off ends that secures one or more bubble vials used to evaluate the proper orientation of a surface to true horizontal or vertical. More preferred is where the levels are torpedo levels. Torpedo levels typically have tapered ends and a working length that is less than that of most frame levels. In a highly preferred embodiment, the torpedo levels being displayed have magnetic elements in each lateral-edge of the level.

In another desired embodiment, the attachment member on the display rack is preferably a bracket assembly for securing the rack to a cross-bar. Most preferred is where the bracket assembly includes a top-bracket and an adjustable bottom-bracket that are spaced apart from one another.

Certain other cases find a hook assembly as the attachment member for mounting the display rack to a pegboard. In these cases, it is more preferred that the hook assembly have a hook-portion and a stabilizer-portion that are spaced-apart from one another. A most highly preferred embodiment is where the holder has a support-panel disposed adjacent to its rear edge and orthogonal to its surfaces. In this embodiment, the hook-portion of the hook assembly is attached at the top of the support-panel and the stabilizer-portion is mounted at the support-panel's bottom.

In another aspect of this invention, a display rack is provided that releasably retains several magnetic levels, preferably torpedo levels, for displaying the levels from a display structure. The rack has a rigid holder formed from an integral sheet of ferrous material, preferably sheet steel. The holder includes two vertical and planar holder-surfaces, each surface being configured to be magnetically engaged by a magnetic element in the lateral edge of each level, and a vertical support-panel at a right angle to the holder-surfaces. The rack further includes a rigid horizontal tray secured to the lower edge of the holder where the tray extends outward orthogonally from both holder-surfaces and is configured to engage and support one end of each level. The rack also has an attachment member that is attached to the support-panel for mounting the display rack to the associated display structure.

In one highly preferred embodiment of this aspect of the invention, the attachment member is a bracket assembly having a top-bracket and a bottom-bracket for attaching the display rack to a cross-bar. More preferred is where the support-panel has an adjustment-slot and the bottom-bracket is secured to the support-panel by a fastener inserted through the adjustment-slot so that the bottom-bracket can be raised or lowered up to the length of the adjustment-slot.

In another desired embodiment, the attachment member is a hook assembly having a hook-portion and a stabilizer-portion for mounting the display rack to a pegboard. In this embodiment, the hook-portion is secured adjacent to the top-end of the support-panel and the stabilizer-portion is secured adjacent to the support-panel's bottom-end.

In a highly desired aspect of this invention, a display rack for multiple magnetic levels includes a rigid, magnetically-attractable holder and an attached stand member. The holder is provided with two substantially vertical holder-surfaces. Each holder-surface is configured to be magnetically engaged by the magnetic element mounted within each level. The stand member allows the rack to be mounted on a display surface.

A most preferred embodiment of this aspect of the invention, the holder has two holder-plates and a front-panel joined to the two at their front edges. More preferred is where each holder-plate is contiguous between its upper edge and lower edge. A highly desired embodiment finds the display rack having each holder-plate perpendicular to the display surface, preferably a horizontal display surface.

Certain preferred cases find the stand member to be a front-support that is secured to the front-panel. Most desired is where the front-support has a horizontal support-flange for engaging the display surface. It is highly preferred that the front-panel have a width less than the length of the support-flange.

Another desired embodiment finds the display rack having a rigid, horizontal tray as the stand member. The tray extends outward from the lower edge of each holder-plate with its upper surface configured to engage and support one end of each level and its lower surface engaging the display surface. Highly preferred is where the stand member further includes a front-support with a horizontal support-flange mounted to the front-panel.

DETAILED DESCRIPTION OF PREFERRED EMBODIMENTS

Figure 1:
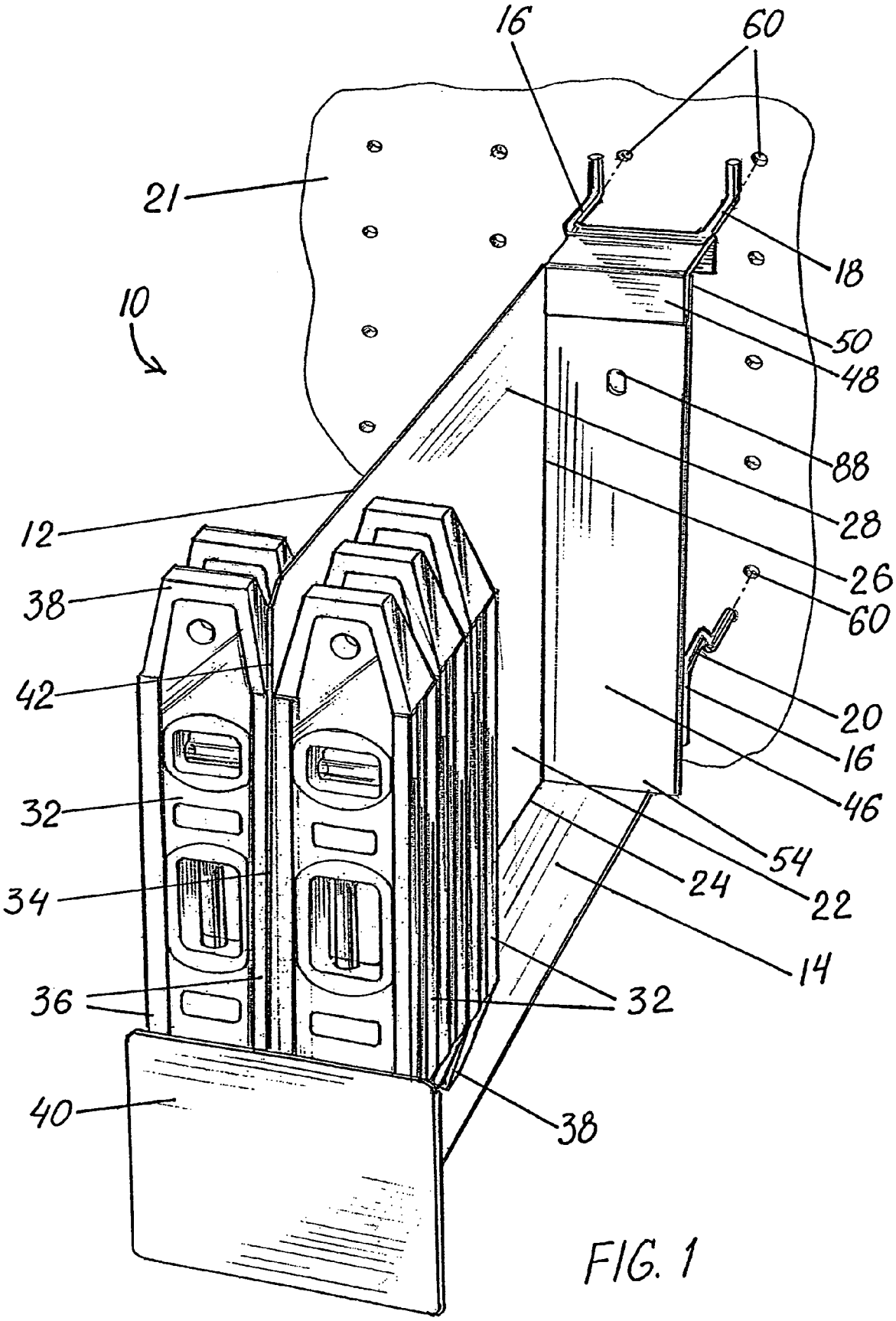
FIG. 1 is a front perspective view of a preferred embodiment of a display rack for levels in accordance with this invention.

The drawings illustrate preferred embodiments of a display rack 10 in accordance with this invention. Display rack 10 has a holder 12, a tray 14, and an attachment member 16. Attachment member 16 is provided to mount display rack 10 to a display structure. In the preferred embodiment shown in FIG. 1, attachment member 16 is a hook assembly having hook member 18 and stabilizer member 20. As shown, members 18, 20 enable display rack 10 to be mounted where the display structure is a pegboard 21.

As further illustrated in FIG. 1, holder 12 includes a substantially vertical holder-plate 22 having a lower edge 24, a rear edge 26, and two opposing vertical holder-surfaces 28. Holder 12 is made from a material that has an attraction to magnetized elements but is not itself a magnet. Such material is preferably a ferrous metal such as sheet steel.

Figure 2:
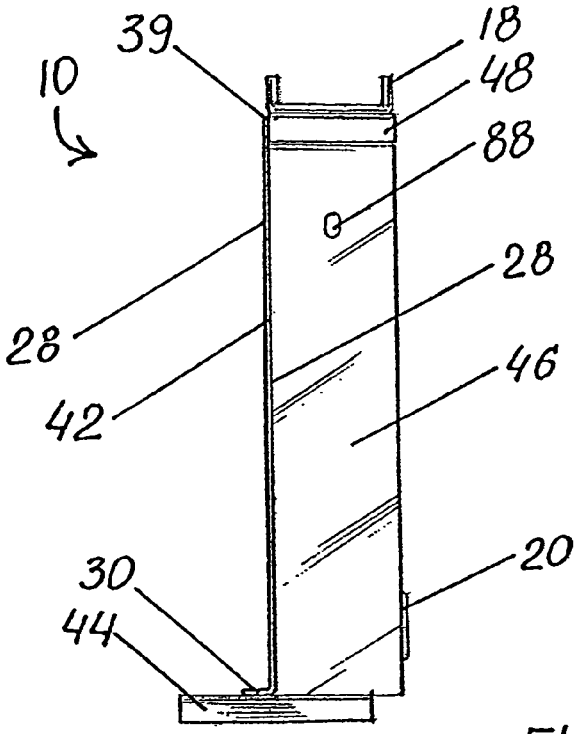
FIG. 2 is a front view of the rack of FIG. 1 having the label-plate removed.

Bottom flange 30 is seen in FIG. 2 to extend at a right angle from holder-plate 22 at lower edge 24. Holder-plate 22 and bottom flange 30 are preferably formed from a single piece of sheet metal by making a 90° bend in the piece along a line defining lower edge 24. The upper surface of tray 14 is rigidly joined to the bottom surface of bottom flange 30, preferably by welding, to secure tray 14 to holder 12.

FIGS. 1–2 illustrate that tray 14 extends orthogonally, i.e. at substantially a 90° angle, outward from both sides of holder-plate 22. One can readily see that in other embodiments in accordance with this invention, tray 14 can be fastened to bottom flange 30 in a manner where tray 14 extends outward from lower edge 24 on only one side of holder-plate 22.

Holder 12 and tray 14 are sized to define space on both sides of holder-plate 22 for displaying multiple magnetic levels 32, preferably torpedo levels as shown in FIG. 1. Each magnetic level 32 includes a magnetic element in the form of a magnetic strip 34. Magnetic strip 34 need only be mounted to one lateral-edge 36 of level 32 but is most commonly found on both lateral-edges 36.

Levels 32 are held in position upon display rack 10 through the magnetic attraction of the magnetic strip 34 to either holder-surface 28. As can further be seen in FIG. 1, tray 14 engages and supports one of the ends 38 on each level 32. This manner of attachment permits levels 32 to be arranged upright in a compact formation for visually presenting an optimal number of individual levels. It will be appreciated that each level can be easily removed by exerting a lateral force away from holder-surface 28 or by sliding the level upward and across upper edge 39 of holder-plate 22.

Holder-plate 22, as shown in FIGS. 1–4, has a contiguous surface from upper edge 39 to lower edge 24. It can be readily appreciated, however, that in other embodiments in accordance with this invention, holder-plate 22 may have one or more apertures such that two or more spaced-apart surface areas are provided. In these embodiments, levels 32 remain in place on display rack 10 by magnetically gripping the areas of holder-surface 28 that abut the lateral-edge 36 contacting the rack.

As seen in FIG. 1, a label-plate 40 is firmly secured to front edge 42 of holder-plate 22. FIG. 2 illustrates that tray 14 includes label-flange 44. Label-flange 44 is adjacent to front edge 42 and orthogonal to the remaining portion of tray 14. Since label-flange 44 extends downward from and is co-planar with front edge 42, label-flange 44 provides additional surface upon which label-plate 40 is mounted. Label-plate 40 is preferably spot welded to label-flange 44 and front edge 42 for strongly joining these structures together.

A user of display rack 10 can place upon label-plate 40 an adhesive label printed or written with indicia that include such information as the make and model of the level displayed, its stock number, and its price. When there is a need for a change in this product information, the label may be peeled off and replaced with another. It will be readily understood that a card holder having a frame designed to receive a card printed with this same information could be used in place of label-plate 40 in other embodiments of this invention.

Figure 4:
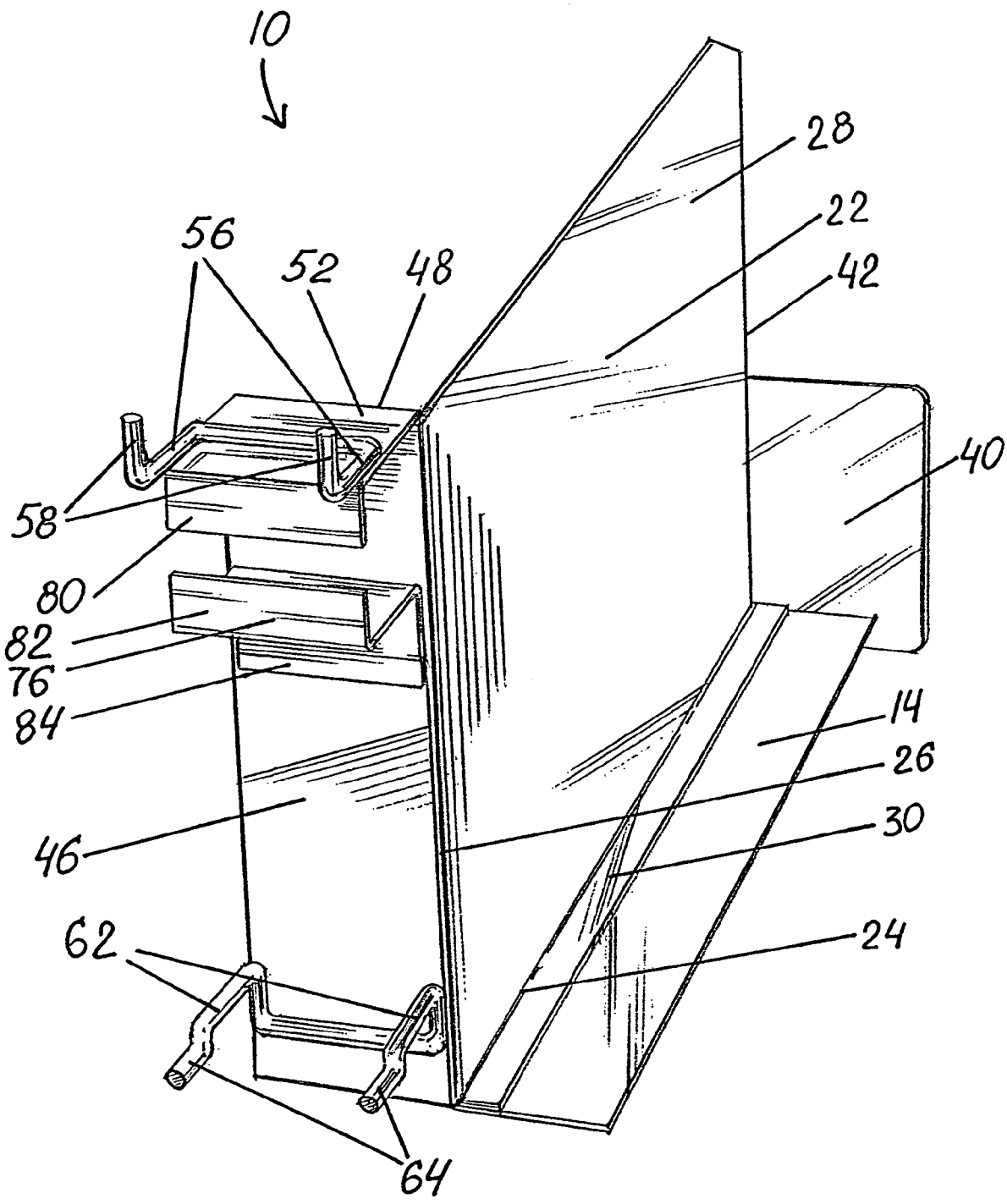
FIG. 4 is a rear perspective view of the rack of FIG. 3.

FIGS. 1 and 4 show support-panel 46 extending outward from rear edge 26. Support-panel 46 is substantially vertical and at substantially right angles to holder-plate 22. Support-panel 46 is preferably formed from the same piece of sheet metal as holder-plate 22 by making a 90° bend in the piece along a line defining rear edge 26.

Hook member 18 and stabilizer member 20 are mounted on support-panel 46. A top-bracket 48 is rigidly fastened, preferably spot welded, to the upper end 50 of support-panel 46. Hook member 18 is firmly attached to the upper surface of the middle portion 52 of top-bracket 48. Stabilizer member 20 is secured to support-panel 46 at a position adjacent to the lower end 54 of support-panel 46. Members 18, 20 are preferably fastened to support-panel 46 by means of welding or a similarly suitable method. Both members 18, 20 are rigid, integral structures preferably formed from stainless steel wire.

As illustrated in FIG. 4, hook member 18 includes two peg-hook portions 56 that extend outward from support-panel 46 towards the rear of display rack 10. Each peg-hook portion 56 has an upwardly directed distal end 58. Peg-hook portions 56 are sized and spaced-apart to fit two corresponding apertures 60 on pegboard 21.

Stabilizer member 20 has two stabilizer-support portions 62 extending rearward from support-panel 46. Each stabilizer-support portion 62 has a distal, substantially horizontal projection 64. Stabilizer-support portions 62 are also sized and spaced apart to be received by two corresponding apertures 60 on pegboard 21.

In mounting display rack 10 onto a wall provided with pegboard 21, as illustrated in FIG. 1, distal ends 58 of hook member 18 are first inserted into two apertures 60 by the user holding display rack 10 at an upward angle with respect to pegboard 21. Upon lowering display rack 10, each distal end 58 is catchably received by its corresponding aperture 60 such that each hook member 18 becomes securely engaged to pegboard 21. Upon lowering display rack 10, projections 64 of stabilizer member 20 are received by two apertures 60 to which projections 64 are in alignment. Each projection 64 frictionally engages the inner surface of the receiving aperture 60 to assist in positively holding display rack 10 in position upon pegboard 21.

Figure 3:
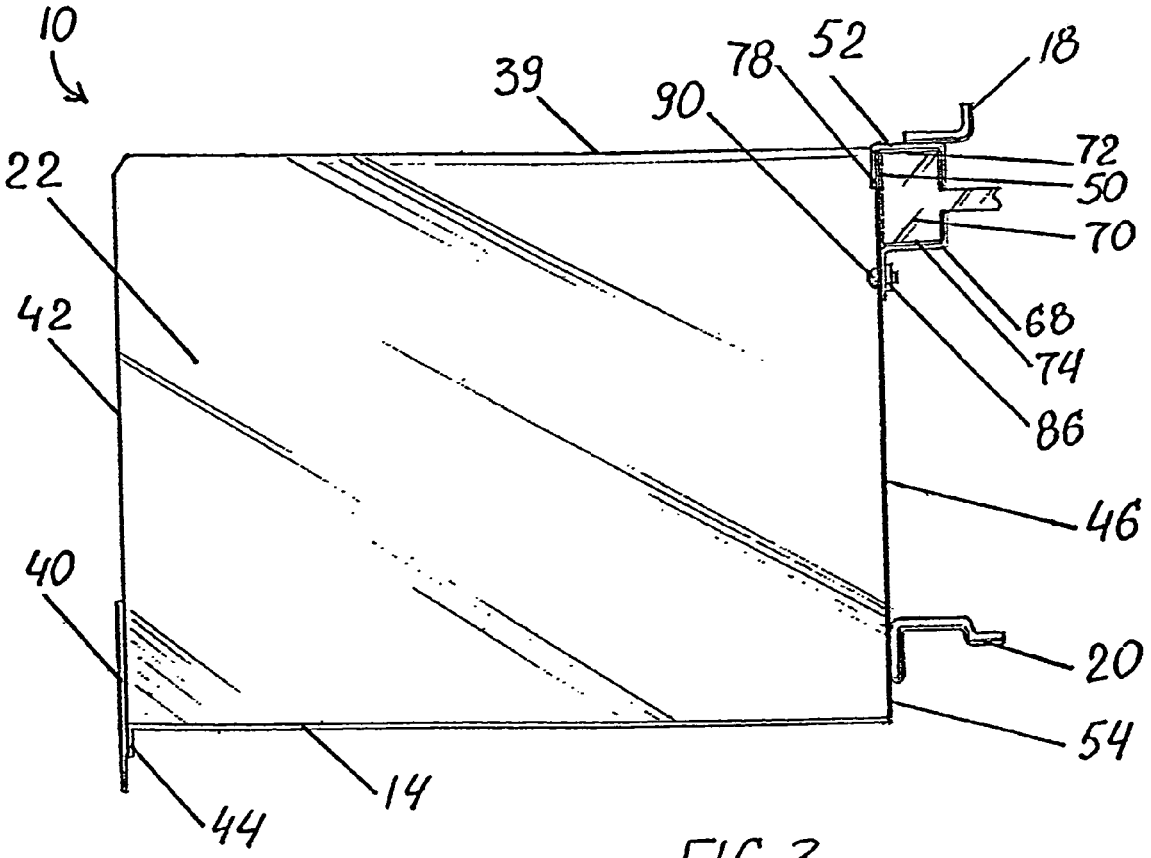
FIG. 3 is a side view of a second preferred embodiment of a display rack for levels in accordance with this invention having the rack mounted to a cross-bar.

As shown in FIG. 3, another embodiment in accordance with the present invention finds the attachment member to be a bracket assembly 68 where the display structure is a cross-bar 70. Cross-bar 70 is a substantially horizontal structure having an upper ledge 72 and a lower ledge 74. Cross-bar 70 may be found fastened directly to a wall or mounted by being snapped onto fixed vertical wall members that allows cross-bar 70 to be easily raised or lowered.

Bracket assembly 68 includes top-bracket 48 and bottom-bracket 76. Top-bracket 48 is C-shaped having a middle portion 52, a proximal portion 78 and a distal portion 80. Proximal portion 78 is rigidly fastened to upper end 50 of support-panel 46. Bottom-bracket 76 has an upwardly extending distal lip 82 and a downwardly extending proximal mount 84. Proximal mount 84 is provided with a bolt aperture (not shown) and weld-nut 86. Weld-nut 86 is coaxial with the bolt aperture and positioned on the surface of proximal mount 84 that faces distal lip 82.

As illustrated in FIG. 3, display rack 10 is mounted onto cross-bar 70 by first positioning distal portion 80 of top-bracket 48 to the rear of upper ledge 72 such that top-bracket 48 catchably engages cross-bar 70. Bottom-bracket 76 is then brought into position by the user between support-panel 46 and cross-bar 70. Distal lip 82 is inserted behind lower ledge 74 and proximal mount 78 is positioned such that weld-nut 86 is in alignment with adjustment-slot 88 of support-panel 46. A fastener, shown in FIG. 3 as bolt 90, is then inserted through adjustment-slot 88 and screwed into weld-nut 86 to firmly secure bottom-bracket 76 in said position where it is catchably engaging lower ledge 74. Upon unscrewing bolt 90, it can be seen that the position of bottom-bracket 76 with respect to support-panel 46 can be raised or lowered along the length of adjustment-slot 88.

Both top-bracket 48 and bottom-bracket 76 are sized to receive upper ledge 72 and lower ledge 74 respectively. It can be readily appreciated that the location of adjustment-slot 88 on support-panel 46 and the vertical length of adjustment-slot 88 will determine the range in the vertical height of cross-bar 70 on which display rack 10 can be mounted.

Figure 5:
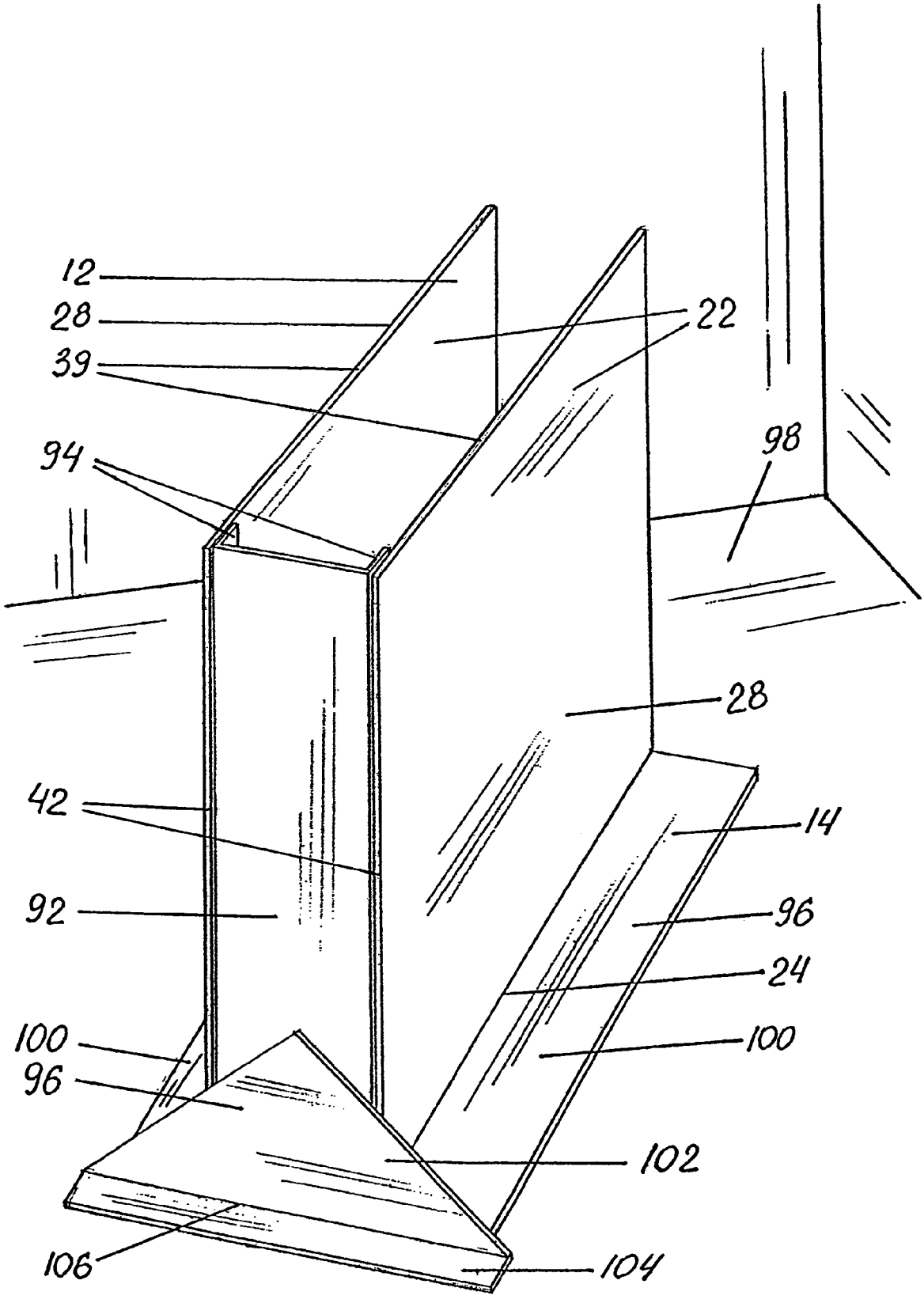
FIG. 5 is a front perspective view of a third preferred embodiment of a display rack for levels in accordance with this invention.

FIG. 5 illustrates another preferred embodiment of a display rack 10 in accordance with this invention. Holder 12 of display rack 10 has two substantially vertical holder-plates 22. A front-panel 92 connects each of the holder-plates 22 to the other. Front-panel 92 is a C-shaped channel having panel-flanges 94, preferably formed from a single piece of sheet metal. The outer surface of each panel-flange 94 is rigidly joined to the corresponding holder-plate 22, preferably by spot welding, adjacent to the front edge 42 of each holder-plate 22.

Display rack 10 includes stand member 96. Stand member 96 is provided to mount display rack 10 to display surface 98. As shown in FIG. 5, stand member 96 includes tray 14. Tray 14 consists of tray-portions 100. Each tray-portion 100 extends outward from the lower edge 24 on the corresponding holder-plate 22.

Each tray-portion 100 is substantially horizontal and is preferably formed along with the corresponding holder-plate 22 from a single piece of sheet metal by bending the piece 90° along a line defining lower edge 24. The bottom surface of tray 14 abuts display surface 98.

As seen in FIG. 5, stand member 96 also includes front-support 102. Front-support 102 is firmly secured to front-panel 92, preferably by spot welding a portion of the back surface of front-support 102 to the lower end of front-panel 92. Support-flange 104 extends outward orthogonally from front-support 102 along support-edge 106. Support-flange 104 is coplanar with tray-portions 100 and together with tray 14 provides support for display rack 10 to stabilize display rack 10 and to maintain holder-plates 22 in an upright configuration whenever display rack 10 is placed upon a horizontal display surface 98 as, for instance, a display counter or on display shelving.

Front-support 102 extends laterally from front-panel 92 on both sides of holder 12 such that support-flange 104 has a length greater than the width of front-panel 92. One can readily appreciate that this configuration of front-support 102 provides display rack 10 with a wider base at one end of holder 12 to assist display rack 10 in staying erect.

As with the other preferred embodiments of this invention, FIG. 5 illustrates that holder-plates 22 are contiguous from upper edge 39 to lower edge 24. Each holder-plate is provided with a holder-surface 28 facing outward from holder 12. Each holder-surface 28 and the corresponding tray-portion 100 are dimensioned to receive an upright formation of magnetic levels. The magnetic strip along a lateral edge on each level allows the levels to magnetically engage either of the two holder-surfaces 28. Each level is further supported by the particular tray-portion 100 abutting one of the ends on the level.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The invention claimed is:

1. A display rack for releasably retaining a plurality of elongate measuring/gauging devices to facilitate displaying the devices from a display structure, each device having opposite ends, two lateral-edges disposed between the ends, and a magnetic element at one lateral-edge, the rack comprising:

a rigid, magnetically-attractable holder having a lower edge, a rear edge, and first and second substantially vertical holder-surfaces, the surfaces being spaced apart by at least the lower and rear edges and each surface being configured to magnetically engage the magnetic lateral-edge of the device;

a rigid, substantially horizontal tray secured with respect to the lower edge of the holder and configured to engage and support one end of the device; and an attachment member secured with respect to the rear edge of the holder, whereby the display rack can be mounted with respect to the display structure.

2. The display rack of claim 1 wherein the holder has an upper edge and the holder is contiguous between the upper edge and lower edge.

3. The display rack of claim 1 wherein the holder has a front edge and further comprising a label-plate secured with respect to the hunt edge.

4. The display rack of claim 1 wherein the measuring/gauging device is a frame-type level.

5. The display rack of claim 4 wherein the frame-type level is a torpedo level.

6. The display rack of claim 5 wherein the level has a magnetic element at both lateral-edges.

7. The display rack of claim 1 wherein the attachment member is a bracket assembly and the display structure is a cross-bar.

8. The display rack of claim 7 wherein the bracket assembly includes a top-bracket and an adjustable bottom-bracket, the top-bracket being in spaced-apart relation to the bottom-bracket.

9. The display rack of claim 1 wherein the attachment member is a hook assembly and the display structure is a pegboard structure.

10. The display rack of claim 9 wherein the hook assembly includes a hook-portion and a stabilizer-portion, the hook-portion being in spaced-apart relation to the stabilizer-port on.

11. The display rack of claim 10 wherein:

the holder includes a support-panel adjacent to the rear edge and substantially orthogonal to the holder-surfaces, the support-panel having a top-end and a bottom-end;

the hook-portion is secured with respect to the support-panel and adjacent to the top-end; and the stabilizer-portion is secured with respect to the support-panel and adjacent to the bottom-end.

12. The display rack of claim 1 wherein the tray extends substantially orthogonally outward with respect to both holder-surfaces.

13. The display rack of claim 1 wherein the holder is formed of ferrous metal.

14. A display rack for releasably retaining a plurality of magnetic levels to facilitate displaying the levels from a display structure, each level having two lateral-edges and a magnetic element mounted with respect to at least one lateral-edge, the rack comprising:

a rigid holder formed from an integral sheet of ferrous material, the holder having a lower edge, first and second substantially vertical and planar holder-surfaces, the surfaces being spaced apart by at least the lower edge and each surface being configured to magnetically engage the magnetic element of the level, and a substantially vertical support-panel substantially orthogonal to the holder-surfaces;

a rigid, substantially horizontal tray secured with respect to the lower edge of the holder, the tray extending outward substantially orthogonal with respect to both holder-surfaces and being configured to engage and support an end of the level; and an attachment member secured with respect to the support-panel, whereby the display rack can be mounted with respect to The display structure.

15. The display rack of claim 14 wherein the attachment member is a bracket assembly, the bracket assembly having a top-bracket and a bottom-bracket, and the display structure is a cross-bar.

16. The display rack of claim 15 wherein the support-panel has an adjustment-slot, the adjustment-slot having a substantially vertical length, and the bottom-bracket is secured to the support-panel by a fastener inserted through the adjustment-slot, whereby the bottom-bracket can be raised or lowered between limits established by the length of the adjustment-slot.

17. The display rack of claim 14 wherein:

the support-panel has a top-end and a bottom-end;

the attachment member is a hook assembly, the hook assembly having a hook-portion and a stabilizer-portion, the hook-portion being secured adjacent to the top-end and the stabilizer-portion being secured adjacent to the bottom-end; and the display structure is a pegboard structure.

18. The display rack of claim 14 wherein the level is a torpedo level.

19. The display rack of claim 14 wherein the ferrous material is sheet steel.

20. A display rack for releasably retaining a plurality of magnetic levels to facilitate displaying the levels, the levels each having at least one lateral-edge with a magnetic element disposed therein, the rack comprising:

a rigid, non-magnetic, magnetically-attractable holder having two substantially vertical holder-surfaces, each surface being configured to magnetically engage the magnetic lateral-edge of the level and the two surfaces not being coplanar; and a stand member secured with respect to the holder, whereby the display rack can be mounted upon a display surface.

21. The display rack of claim 20 wherein the holder includes first and second holder-plates, each holder-plate having one holder-surface and a front edge, and a front-panel secured with respect to the front edge of each holder-plate.

22. The display rack of claim 21 wherein the holder-plates each have an upper edge and a lower edge and each is contiguous between the upper edge and lower edge.

23. The display rack of claim 21 wherein the holder-plates are orthogonal to the display surface.

24. The display rack of claim 23 wherein the display surface is substantially horizontal.

25. The display rack of claim 21 wherein the stand member is a front-support mounted with respect to the front-panel.

26. The display rack of claim 25 wherein the front-support includes a substantially horizontal support-flange engaging the display surface.

27. The display rack of claim 26 wherein the front-panel has a width and the support-flange has a length, the length of the support-flange being greater than the width of the front-panel.

28. The display rack of claim 21 wherein:

the levels each have opposite ends;

the holder-plates each have a lower edge; and the stand member is a rigid, substantially horizontal tray extending outward from the lower edge of each holder-plate and engaging the display surface, the tray being configured to engage and support one end of the level.

29. The display rack of claim 28 wherein the stand member further includes a front-support mounted with respect to the front-panel, the front-support having a substantially horizontal support-flange engaging the display surface.

* * * * *

UNITED STATES PATENT AND TRADEMARK OFFICE

CERTIFICATE OF CORRECTION

PATENT NO. : 7,219,808 B2
APPLICATION NO. : 10/867543
DATED : May 22, 2007
INVENTOR(S) : Randall J. Wright et al.

It is certified that error appears in the above-identified patent and that said Letters Patent is hereby corrected as shown below:

Column 7, line 53, delete “hunt” and insert --front--.

Column 8, line 7, delete “port on” and insert --portion--.

Column 8, line 42, delete “The” and insert --the--.

Signed and Sealed this

Twenty-third Day of October, 2007

JON W. DUDAS
*Director of the United States Patent and Trademark Office*